US009133689B2

(12) United States Patent
George et al.

(10) Patent No.: US 9,133,689 B2
(45) Date of Patent: Sep. 15, 2015

(54) SLEEVE VALVE

(75) Inventors: Grant George, Kelowna (CA); Shane Sargent, Kelowna (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 551 days.

(21) Appl. No.: 13/274,893

(22) Filed: Oct. 17, 2011

(65) Prior Publication Data

US 2012/0125627 A1 May 24, 2012

Related U.S. Application Data

(60) Provisional application No. 61/344,812, filed on Oct. 15, 2010.

(51) Int. Cl.
*E21B 34/14* (2006.01)
*E21B 43/26* (2006.01)
*E21B 34/00* (2006.01)

(52) U.S. Cl.
CPC ..... *E21B 34/14* (2013.01); *E21B 43/26* (2013.01); *E21B 2034/007* (2013.01)

(58) Field of Classification Search
CPC .. E21B 34/102; E21B 34/14; E21B 2034/007
USPC ..... 166/383, 319, 323, 334.1
See application file for complete search history.

(56) References Cited

U.S. PATENT DOCUMENTS 2,775,304 A 12/1956 Zandmer
5,249,628 A 10/1993 Surjaatmadja
5,325,923 A 7/1994 Surjaatmadja et al.
5,361,856 A 11/1994 Surjaatmadja et al.
5,379,838 A 1/1995 Wilson et al.
5,396,957 A 3/1995 Surjaatmadja et al.
5,425,424 A 6/1995 Reinhardt et al.
5,479,989 A * 1/1996 Shy et al. ..... 166/332.4
5,494,103 A 2/1996 Surjaatmadja et al.
6,380,138 B1 4/2002 Ischy et al.
7,267,172 B2 9/2007 Hofman
7,422,060 B2 9/2008 Hammami et al.
7,422,069 B2 9/2008 Richard et al.
7,556,102 B2 * 7/2009 Gomez ..... 166/373
7,591,312 B2 9/2009 Johnson et al.
7,604,055 B2 10/2009 Richard et al.
2002/0007949 A1 1/2002 Tolman et al.
2006/0207763 A1 9/2006 Hofman
2009/0044944 A1 2/2009 Murray et al.
2010/0122817 A1 5/2010 Surjaatmadja et al.
2012/0118573 A1 5/2012 Richard et al.

(Continued)

*Primary Examiner* — Cathleen Hutchins
(74) *Attorney, Agent, or Firm* — Jeffery R. Peterson; Brandon Clark

(57) ABSTRACT

An apparatus and method for selectably opening a valve body having a central passage and a plurality of apertures therethrough. The apparatus comprises a sleeve slidably located within the central passage of the valve body adapted to selectably cover or uncover the apertures. The apparatus further comprises a shifting tool slidably locatable within the sleeve having at least one sleeve engaging member selectably extendable therefrom in parallel to a central axis thereto engagable upon the sleeve wherein the shifting tool is moveable. The method comprises positioning the shifting tool within the sleeve in a first or second position, extending the sleeve engaging members from the shifting tool in parallel to a central axis of the shifting tool into engagement upon the sleeve, and axially moving the shifting tool and the sleeve to the other of the first or second positions.

9 Claims, 17 Drawing Sheets

(56) References Cited

U.S. PATENT DOCUMENTS

2012/0125627 A1 5/2012 George et al.
2012/0152550 A1 6/2012 East
2013/0048273 A1 2/2013 Crow et al.

* cited by examiner

SLEEVE VALVE

CROSS REFERENCE TO RELATED APPLICATION

This application claims priority from U.S. Provisional Patent Application No. 61/344,812 filed Oct. 15, 2010 entitled Downhole Control Valve System.

BACKGROUND OF THE INVENTION

1. Field of Invention

The present invention relates to hydrocarbon well control in general and in particular methods and apparatuses for selectably opening and closing zones within a hydrocarbon well during completion, hydraulic fracturing or production.

2. Description of Related Art

In hydrocarbon production, it has become common to utilize directional or horizontal drilling to reach petroleum containing rocks, or formations, that are either at a horizontal distance from the drilling location. Horizontal drilling is also commonly utilized to extend the wellbore along a horizontal or inclined formation or to span across multiple formations with a single wellbore. With horizontal drilling the well casing is prone to resting upon the bottom of the wellbore requiring the use of spacers so as to centre the casing within the wellbore.

In horizontal hydrocarbon wells, it is frequently desirable to select which zone of the wellbore is to be opened for production or to stimulate one or more zones of the well to increase production of that zone from time to time. One current method of stimulating a portion of the well is through the use of hydraulic fracturing or fracing. One difficulty with conventional fracing systems, it that is necessary to isolate the zone to be stimulated on both the upper and lower ends thereof so as to limit the stimulation to the desired zone. Such isolation has typically been accomplished with sealing elements known as production packers located to either side of the zone to be isolated. The use of such One of the prior problems with current fracing methods is that most hydrocarbon wells are constructed with a well casing located within the wellbore which is cemented in place by pumping cement down the casing to the bottom of the well so as to fill the annulus between the casing and the wellbore from the bottom up. Such concrete provides an additional barrier between the center of the well casing and wellbore which is to be fraced. In conventional methods, in order to thereafter frac a zone which has been constructed in such a manner, it is necessary to form a conduit from the interior of the casing to the wellbore wall by fracturing the cement as well as the formation. Needing to fracture the concrete as well as the formation increases the pressure required for the fracing process thereby increasing the equipment requirements as well as the resulting cost and time requirements.

Previous attempts to resolve some of the above difficulties has been to provide valves inline within the casing so as to selectably provide access to the desired zones of the well. Such valves may be sliding valves having actuators such as are described in US Patent Application Publication No. 2006/0207763 to Hofman published Sep. 21, 2006. With the use of such sliding valves however, it is still necessary to fracture, dissolve or otherwise perforate the concrete surrounding the casing to access the formation.

SUMMARY OF THE INVENTION

According to a first embodiment of the present invention there is disclosed an apparatus for selectably opening a valve body in a well casing having a central passage and a plurality of apertures therethrough. The apparatus comprises a sleeve slidably located within the central passage of the valve body adapted to selectably cover or uncover the apertures and a shifting tool slidably locatable within the sleeve. The apparatus further comprises at least one sleeve engaging member selectably extendable from the shifting tool in parallel to a central axis of the shifting tool and engagable upon the sleeve wherein the shifting tool is moveable so as to cause the sleeve to selectably cover and uncover the apertures.

The sleeve may be axially displaceable within the central passage. The sleeve may be displacable between a first position covering the apertures and a second position uncovering the apertures. The sleeve may seal the apertures in the first position.

The shifting tool may be securable to the end of a production casing nested within the well casing. The shifting tool may include a central bore therethrough. The central bore may include a plurality of shifting bores extending therefrom, each shifting bore having a piston therein operably connected to a sleeve engaging member for extending the sleeve engaging member when the central bore is supplied with a pressurized fluid.

The sleeve engaging members may comprise elongate members extending between first and second ends. The sleeve engaging members may extend parallel to an axis of the central bore. The first and second ends of the sleeve engaging members may include first and second catches for engaging corresponding first and second ends of the sleeve. The first and second catches may be spaced apart by a distance sufficient or receive the sleeve therebetween.

The first and second ends of the elongate members may include corresponding first and second inclined surfaces. The central passage may include a raised portion proximate to the first position of the sleeve so as to be engaged by the first inclined surface as the sleeve is moved into the first position and thereby to disengage the catches from the sleeve. The central passage may include a raised portion proximate to the second position of the sleeve so as to be engaged by the second inclined surface as the sleeve is moved into second first position and thereby to disengage the catches from the sleeve.

Each sleeve engaging member may include a shaft extending therealong and at least two linking arms extending from the shaft to the sleeve engaging member so as to maintain the sleeve engaging member parallel thereto. The linking arms may be received within sockets within the sleeve engaging member.

According to a further embodiment of the present invention there is disclosed an apparatus for shifting a sleeve of a sleeve valve, the sleeve valve comprising a valve body with at least one aperture extending therethrough and an axially displaceable sleeve adapted to selectably cover or uncover the apertures. The apparatus comprises an shifting tool slidably locatable within the sleeve and at least one sleeve engaging member selectably extendable from the shifting tool in parallel a central axis of the shifting tool and engagable upon the sleeve.

According to a further embodiment of the present invention there is disclosed a method for selectably opening a valve body in a well casing having a central passage and a plurality of apertures therethrough. The method comprises providing a sleeve slidably located within the central passage of the valve body adapted to selectably cover or uncover the apertures. The sleeve is located in one of a first or second position. The method further comprises positioning an shifting tool slidably locatable within the sleeve, extending the at least one sleeve engaging member selectably extendable from the shifting tool in parallel to a central axis of the shifting tool into engagement upon the sleeve, and axially moving the shifting tool and the sleeve to an other of the first or second positions.

The method may further comprise disengaging the at least one sleeve engaging member from the sleeve at the other of the first or second positions.

According to a further embodiment of the present invention there is disclosed a method for actuating a sleeve valve, the sleeve valve comprising a valve body with at least one aperture extending therethrough and an axially displaceable sleeve adapted to selectably cover or uncover the apertures. The method comprises locating a shifting tool within the sleeve, extending at least one sleeve engaging member from the shifting tool until engaged upon the sleeve, axially moving the shifting tool and sleeve and retracting the sleeve engaging member until disengaged from the sleeve.

According to a further embodiment of the present invention there is disclosed a method for applying a fluid actuation pressure to a portion of an actuator, the method comprising sealably locating a valve body within the interior of the actuator, the valve body having an interior cavity therein and applying a fluid pressure to an upstream end of the valve body. The method further comprises slidably displacing a piston within the interior cavity after the fluid pressure reaches a desired pressure so as to open a fluid path through the valve body and passing the fluid through ports in an exterior of the valve body to provide the supply pressure to the actuator.

According to a further embodiment of the present invention there is disclosed an apparatus for applying a fluid actuation pressure to a portion of an actuator comprising a valve body sealably locatable within the interior of the actuator, having an interior cavity. The valve body has a cylinder portion and a spring housing portion. The spring housing portion has a plurality of ports therethrough at a location corresponding to the actuator. The apparatus further includes an entrance end for applying a fluid pressure to an upstream end of the valve body and a rod slidably locatable within the cylinder portion. The entrance end is in fluidic communication with the cylinder portion. The rod has a piston sealed within the interior of the cylinder portion, the rod and piston displaceable to an actuating position wherein the piston is displaced out of the cylinder portion so as to place the entrance end in fluidic communication with the spring housing portion. The apparatus further comprises a compression spring engaged against a downstream portion of the rod and piston so as to bias the rod and piston into a closed position within the cylinder portion and an outlet orifice at a downstream end of the spring portion so as to release fluid from the spring housing at a desired rate.

According to a further embodiment of the present invention there is disclosed a method for applying a fluid actuation pressure to a portion of an actuator. The method comprises sealably securing a valve body to a distal end of the actuator and pumping a pressurized fluid through the valve body and actuator so as to provide an actuation pressure to the actuator.

According to a further embodiment of the present invention there is disclosed a method for opening a passage through a terminal end of a production string. The method comprises providing a valve body at a distal end of the production string, providing an actuation pressure to actuation fluid within the so as to open a flap at a distal end thereof. The flap being operably connected to an annular piston longitudinally displaceable within the valve body and being biased with a spring so as to bias the flap to a closed position.

According to a further embodiment of the present invention there is disclosed an apparatus for selectably sealing and pressurizing a production string. The apparatus comprises a valve body connectable to a distal end of a production string, the valve body having an interior cavity in fluidic communication with the production string and an annulus between the valve body and the well casing and a flapper valve rotatably located at a distal end of the interior cavity at a distal end of the valve body. The apparatus further comprises a spring biased piston longitudinally displaceable within the valve body, the piston operatively connected to the flapper valve so as to bias the flapper valve to a closed position and be openable when a fluid is pumped through the interior cavity.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
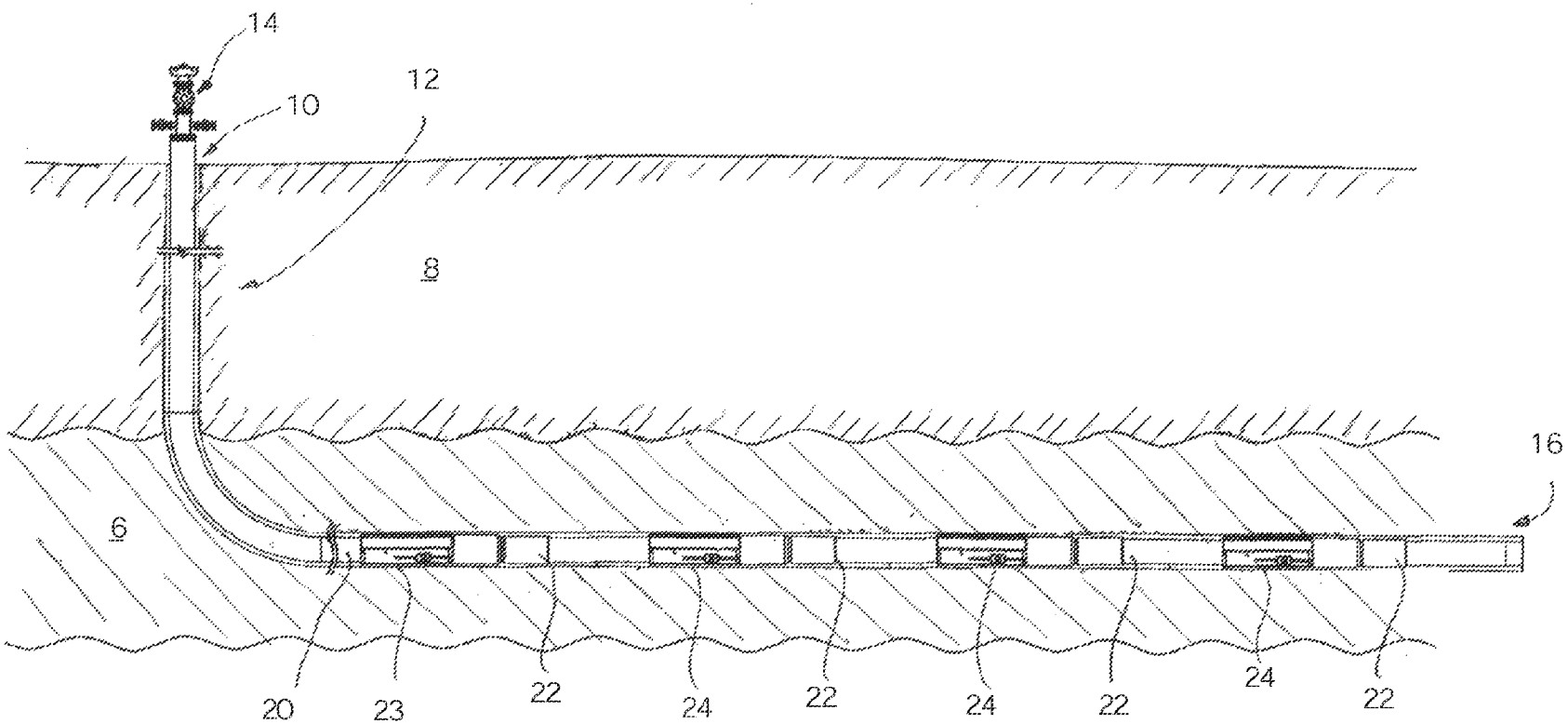
FIG. 1 is a cross-sectional view of a wellbore having a plurality of flow control valves according to a first embodiment of the present invention located therealong.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the production tubing 20 is of the hydrocarbon well is formed of a plurality of alternating liner or casing 22 sections and in line valve bodies 24 surrounded by a layer of cement 23 between the casing and the wellbore. The valve bodies 24 are adapted to control fluid flow from the surrounding formation proximate to that valve body and may be located at predetermined locations to correspond to a desired production zone within the wellbore. In operation, between 8 and 100 valve bodies may be utilized within a wellbore although it will be appreciated that other quantities may be useful as well.

Figure 2:
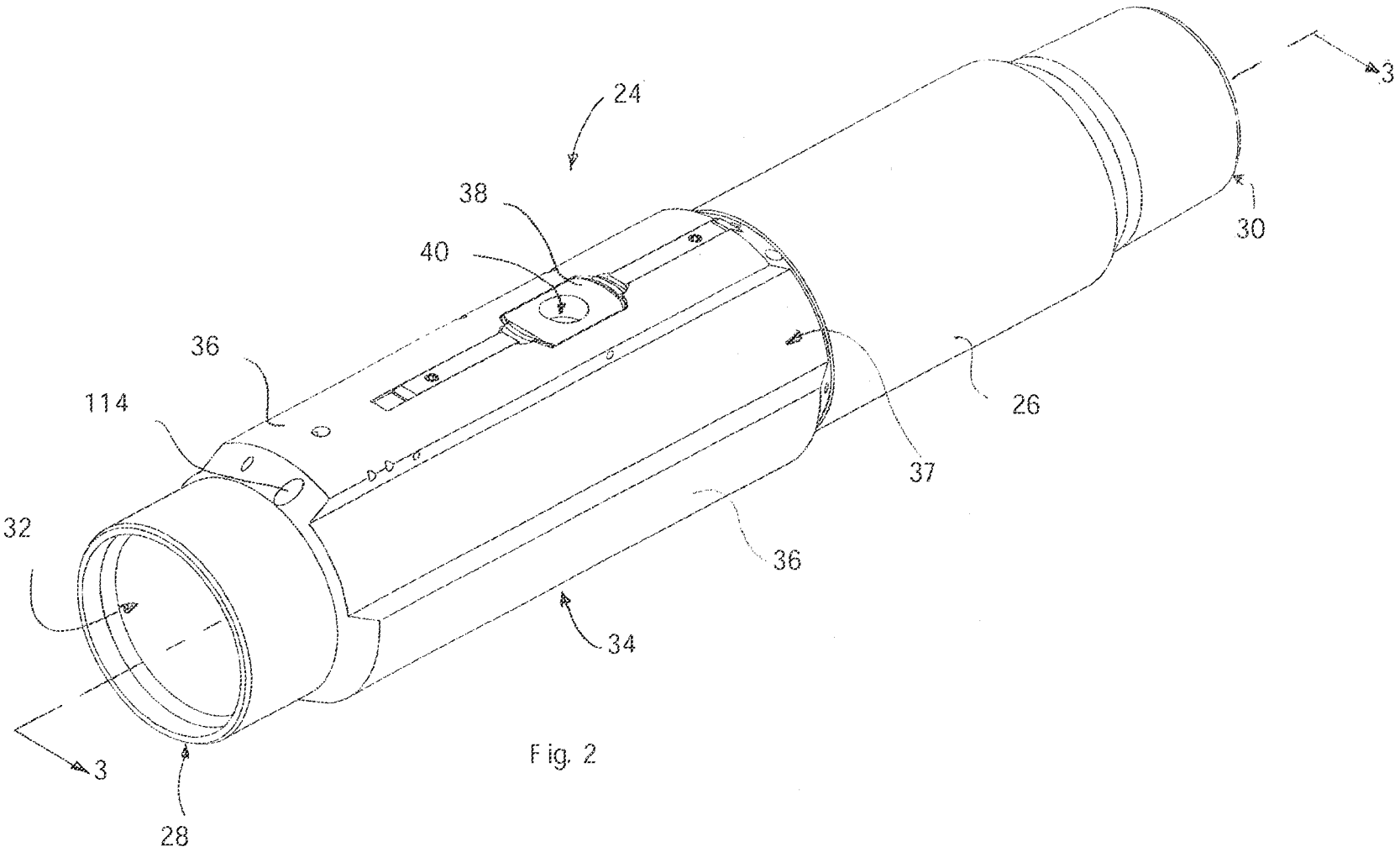
FIG. 2 is a perspective view of one of the control valves of FIG. 1.

Turning now to FIG. 2, a perspective view of one valve body 24 is illustrated. The valve body 24 comprises a substantially elongate cylindrical outer casing 26 extending between first and second ends 28 and 30, respectively and having a central passage 32 therethrough. The first end 28 of the valve body is connected to adjacent liner or casing section 22 with an internal threading in the first end 28. The second end 30 of the valve body is connected to an adjacent casing section with external threading around the second end 30. The valve body 24 further includes a central portion 34 having a plurality of raised sections 36 extending axially therealong with passages 37 therebetween. As illustrated in the accompanying figures, the valve body 24 has three raised sections although it will be appreciated that a different number may also be utilized.

Each raised section 36 includes a port body 38 therein having an aperture 40 extending therethrough. The aperture 40 extends from the exterior to the interior of the valve body and is adapted to provide a fluid passage between the interior of the bottom section 16 and the wellbore 10 as will be further described below. The aperture 40 may be filled with a sealing body (not shown) when installed within a bottom section 16. The sealing body serves to assist in sealing the aperture until the formation is to be fractured and therefore will have sufficient strength to remain within the aperture until that time and will also be sufficiently frangible so as to be fractured and removed from the aperture during the fracing process. Additionally, the port bodies 38 are radially extendable from the valve body so as to engage an outer surface thereof against the wellbore 10 so as to center the valve body 24 and thereby the production section within the wellbore.

Figure 3:
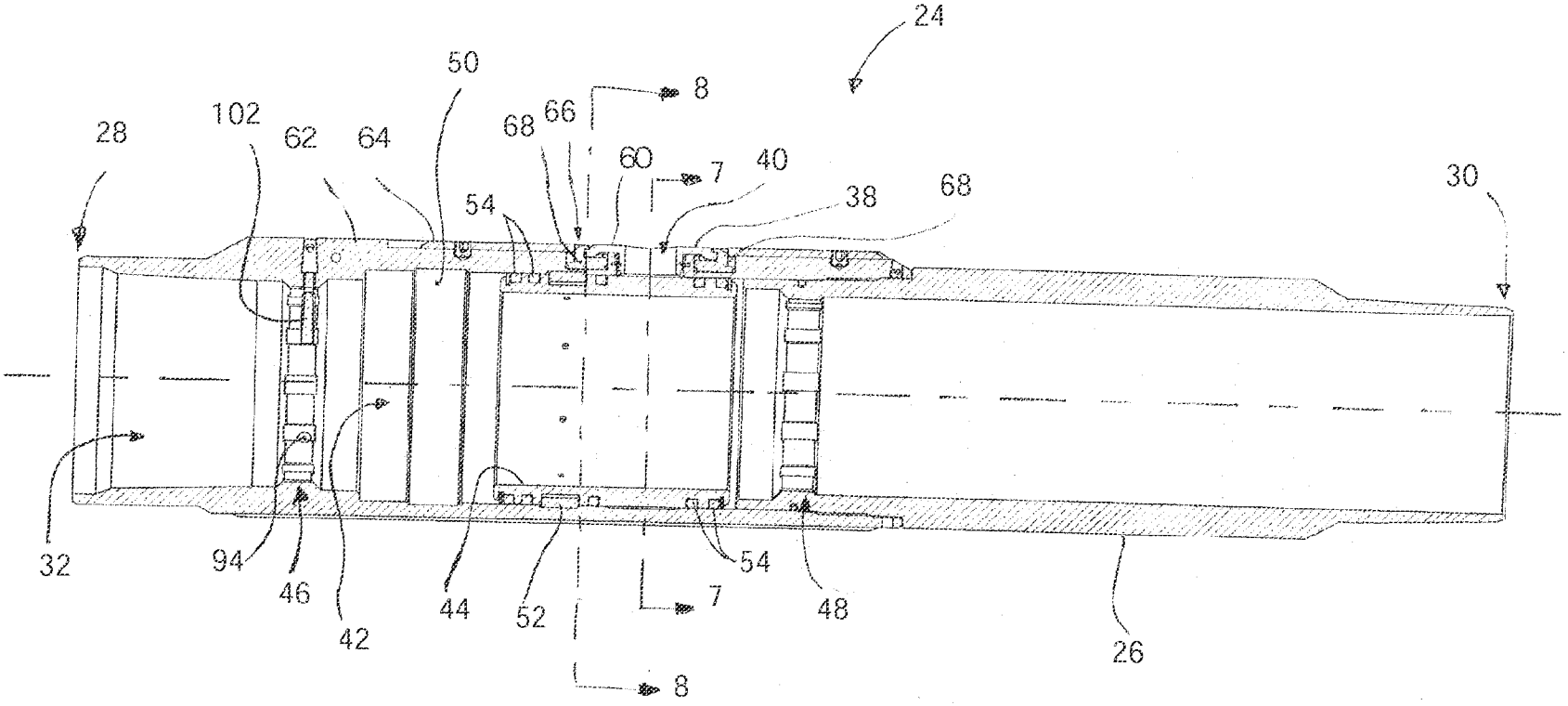
FIG. 3 is a longitudinal cross-sectional view of the control valve of FIG. 2 as taken along the line 3-3.

Turning now to FIG. 3, a cross sectional view of the valve body 24 is illustrated. The central passage 32 of the valve body includes a central portion 42 corresponding to the location of the port bodies 38. The central portion is substantially cylindrical and contains a sliding sleeve 44 therein. The central portion 42 is defined between first or entrance and second or exit raised portions or annular shoulders, 46 and 48, respectively. The sliding sleeve 44 is longitudinally displaceable within the central portion 42 to either be adjacent to the first or second shoulder 46 or 48. At a location adjacent to the second shoulder, the sliding sleeve 44 sealably covers the apertures 40 so as to isolate the interior from the exterior of the bottom section 16 from each other, whereas when the sliding sleeve 44 is adjacent to the first shoulder 46, the sliding sleeve 44

Figure 4:
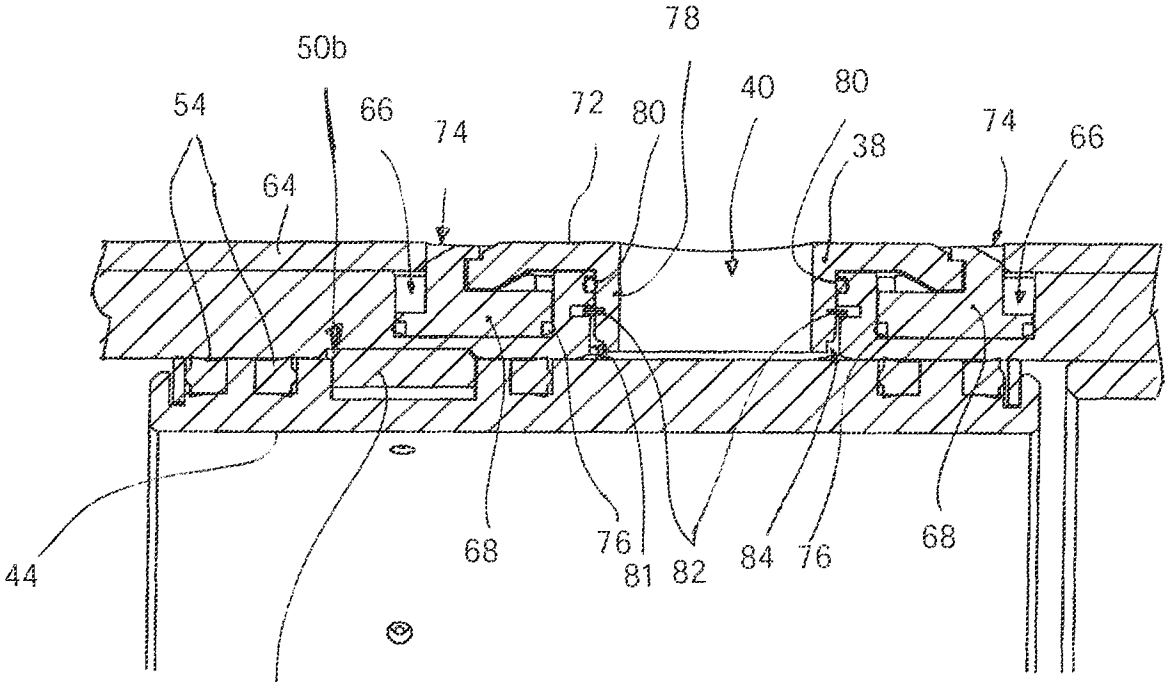
FIG. 4 is a detailed cross-sectional view of the extendable ports of the valve of FIG. 2 in a first or retracted position.
Figure 5:
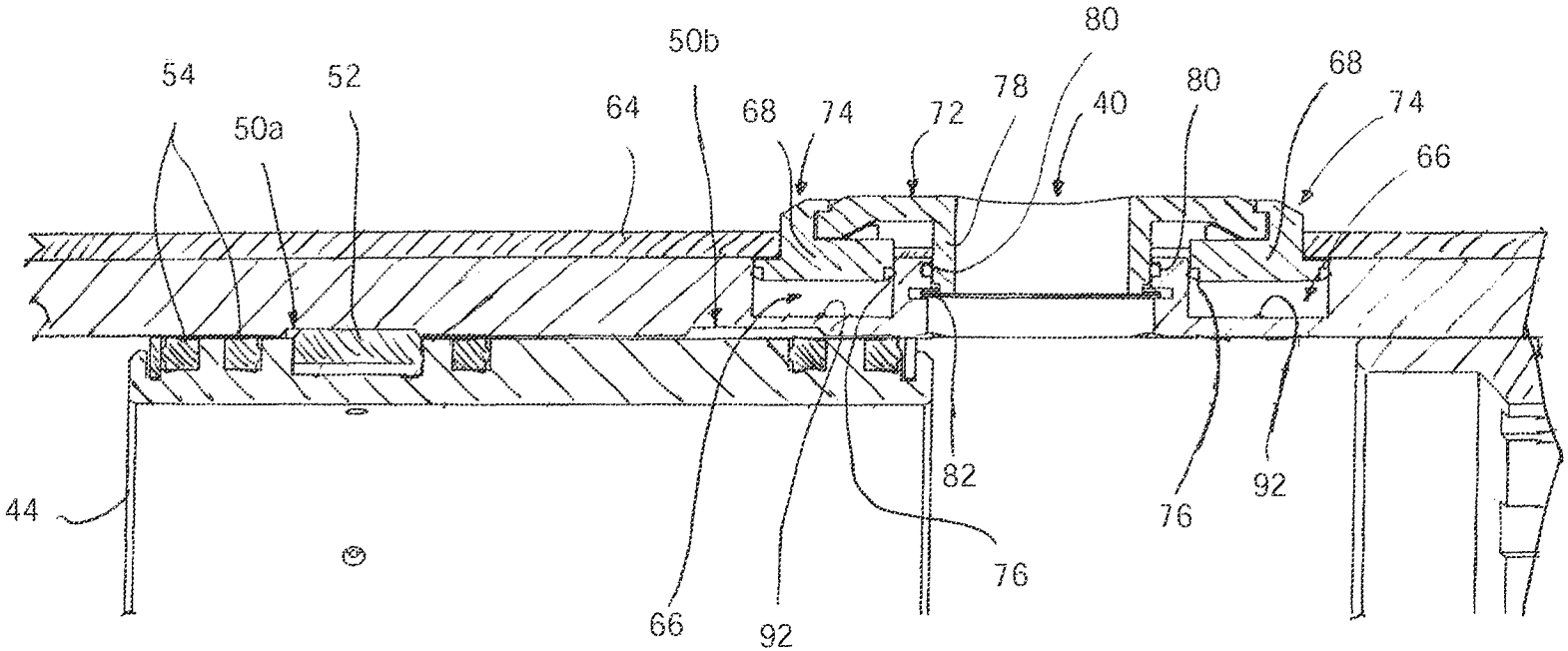
FIG. 5 is a detailed cross-sectional view of the extendable ports of the valve of FIG. 2 in a second or extended position with the sleeve valve in an open position.

The central portion 42 includes a first annular groove 50*a* therein proximate to the first shoulder 46. The sliding sleeve 44 includes a radially disposed snap ring 52 therein corresponding to the groove 50*a* so as to engage therewith and retain the sliding sleeve 44 proximate to the first shoulder 46 which is an open position for the valve body 24. The central portion 42 also includes a second annular groove 50*b* therein proximate to the aperture 40 having a similar profile to the first annular groove 50*a*. The snap ring 52 of the sleeve is receivable in either the first ore second annular groove 50*a* or 50*b* such that the sleeve is held in either an open position as illustrated in FIG. 5 or a closed position as illustrated in FIG. 4. The sliding sleeve 44 also includes annular wiper seals 54 which will be described more fully below proximate to either end thereof to maintain a fluid tight seal between the sliding sleeve and the interior of the central portion 42.

The port bodies 38 are slidably received within the valve body 24 so as to be radially extendable therefrom. As illustrated in FIG. 3, the port bodies are located in their retracted position such that an exterior surface 60 of the port bodies is aligned with an exterior surface 62 of the raised sections 36. Each raised section may also include limit plates 64 located to each side of the port bodies 38 which overlap a portion of and retain pistons within the cylinders as are more fully described below.

Each raised section 36 includes at least one void region or cylinder 66 disposed radially therein. Each cylinder 66 includes a piston 68 therein which is operably connected to a corresponding port body 38. Turning now to FIGS. 4 and 5, detailed views of one port body 38 are illustrated at a retracted and extended position, respectively. Each port body 38 may have an opposed pair of pistons 68 associated therewith arranged to opposed longitudinal sides of the valve body 24. It will be appreciated that other quantities of pistons 68 may also be utilized for each port body 38 as well. The pistons 68 are connected to the valve body by a top plate 70 having an exterior surface 72. The exterior surface 72 is positioned to correspond to the exterior surface 62 of the raised sections 36 so as to present a substantially continuous surface therewith when the port bodies 38 are in their retracted positions. The exterior surface 72 also includes angled end portions 74 so as to provide a ramp or inclined surface at each end of the port body 38 when the port bodies 38 are in an extended position. This will assist in enabling the valve body to be longitudinally displaced within a wellbore 10 with the vertical section 12 under thermal expansion of the production string and thereby to minimize any shear stresses on the port body 38.

The pistons 68 are radially moveable within the cylinders relative to a central axis of the valve body so as to be radially extendable therefrom. In the extended position illustrated in FIG. 5, the exterior surface 72 of the port bodies are adapted to be in contact with the wellbore 10 so as to extend the port body 38 and thereby enable the wellbore 10 to be placed in fluidic communication with the central portion 42 of the valve body 24. The pistons 68 may have a travel distance between their retracted positions and their extended positions of between 0.10 and 0.50 inches although it will be appreciated that other distances may also be possible. In the extended position, it will be possible to frac that location without having to also fracture the concrete which will be located between the valve body 24 and the wellbore wall thereby reducing the required frac pressure. Additionally, more than one port body 38 may be utilized and radially arranged around the valve body so as to centre the valve body within the wellbore when the port bodies are extended therefrom.

The pistons 68 may include seals 76 therearound so as to seal the piston within the cylinders 66. Additionally, the port body 38 may include a port sleeve 78 extending radially inward through a corresponding port bore 81 within the valve body. A seal 80 may be located between the port sleeve 78 and the port bore 81 so as to provide a fluid tight seal therebetween. A snap ring 82 may be provided within the port bore 81 adapted to bear radially inwardly upon the port sleeve 78. In the extended position, the snap ring 82 compresses radially inwardly to provide a shoulder upon which the port sleeve 78 may rest so as to prevent retraction of the port body 38 as illustrated in FIG. 5.

Figure 6:
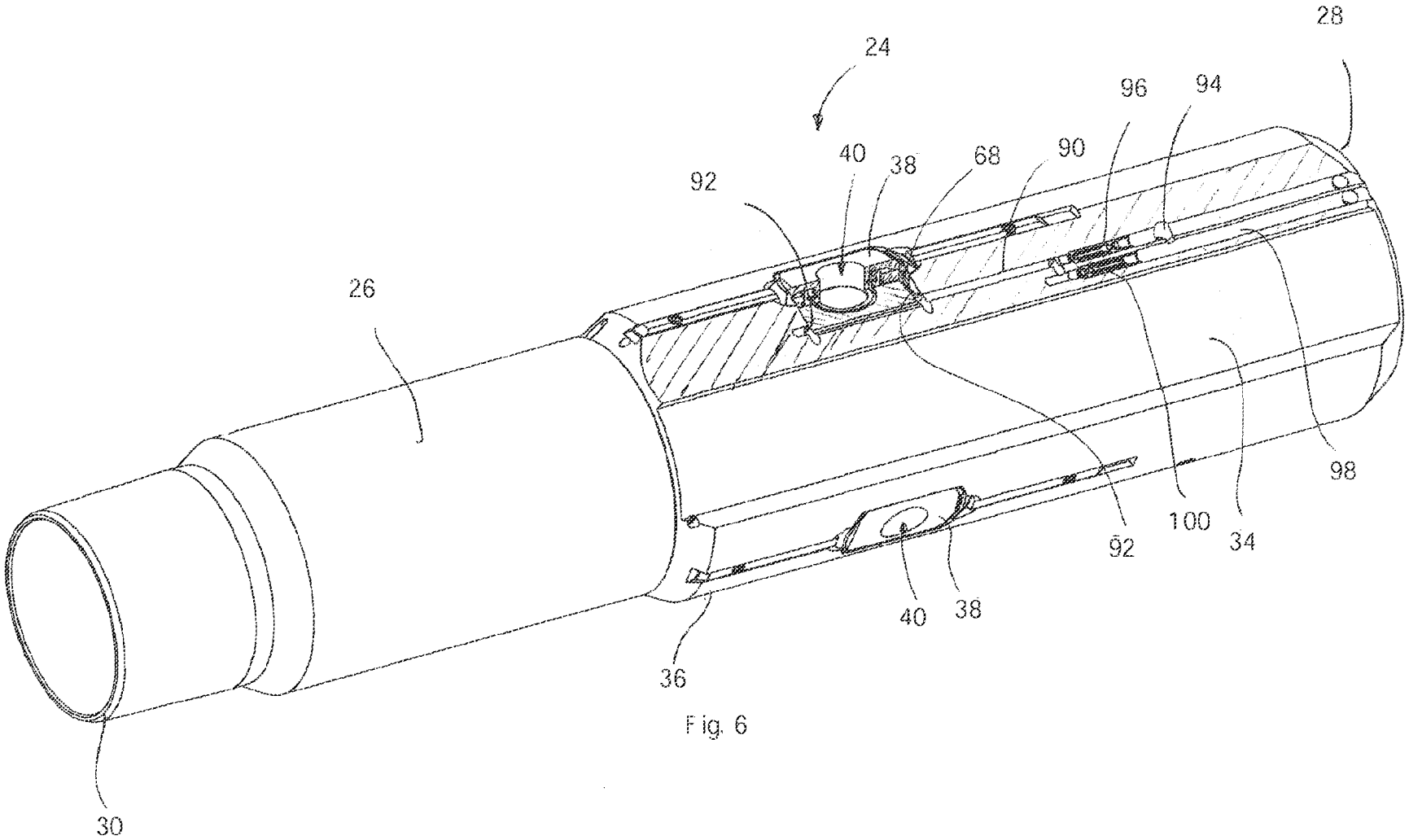
FIG. 6 is a partial cross-sectional view of one raised portion of the valve body of FIG. 2 illustrating a fluid control system for extending the FIG. 7 is an axial cross-sectional view of the control valve of FIG. 2 as taken along line 7-7.
Figure 8:
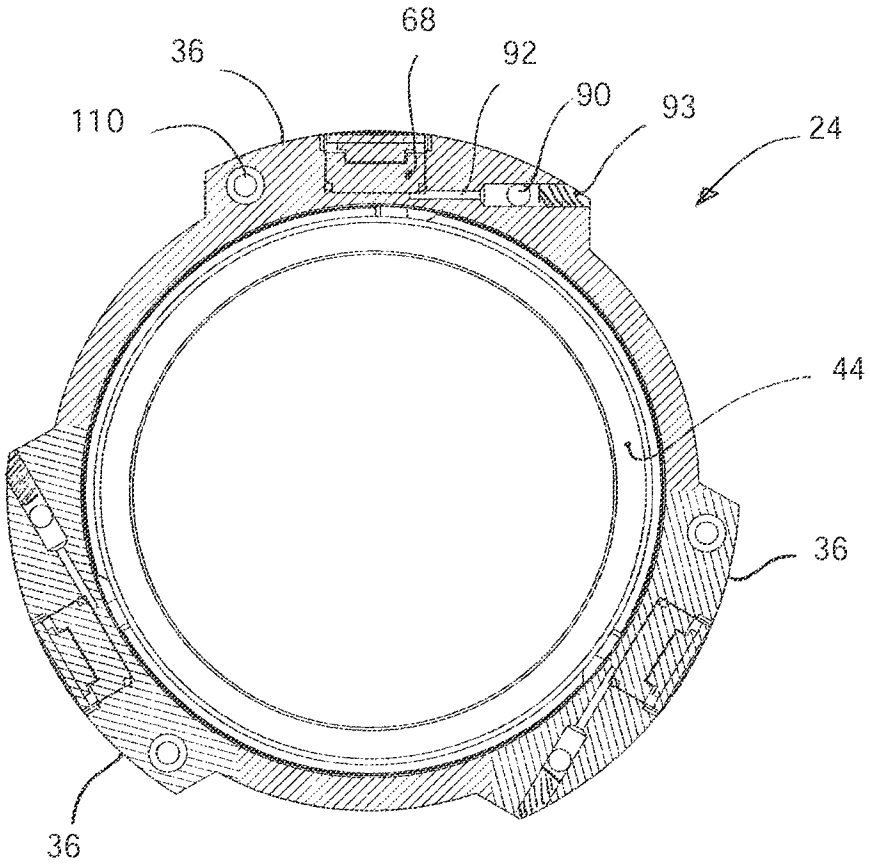
FIG. 8 is an axial cross-sectional view of the control valve of FIG. 2 as taken along line 8-8.

The pistons 68 may be displaceable within the cylinders 66 by the introduction of a pressurized fluid into a bottom portion thereof. As illustrated in FIG. 6, a fluid control system is illustrated for providing a pressurized fluid to the bottom portion of the cylinder 66 from the interior of the valve body 24. In this way a fluid pumped down the center of the bottom section 16 may be utilized to extend the port bodies 38. The fluid control system comprises a fluid bore 90 extending longitudinally within the raised section 36 between an entrance bore 94 and a pair of spaced apart piston connection bores 92. The piston connection bores 92 intersect the bottom portion of the cylinders 66 while the entrance bore extends to the central passage 32 of the valve body 24. The fluid bore 90 may include a relief check valve 96 located therein so as to only pressurize the cylinders 66 when a fluid of a sufficient pressure has been pumped down the production string. In operation, a user may select a check valve 96 of the desired actuation pressure which may be between 500 and 2000 pounds per square inch (psi) with a pressure of between 1000 and 1200 being particularly useful. Other pressures may also be selected which are sufficient to centralize the valve body 24 within the wellbore. This pressure may be referred to as an extension pressure. The fluid control system also includes a relieve bore 98 extending from the fluid bore 90 to an exterior of the valve body 24. As illustrated in FIG. 8, the piston connection bores 92 may be formed by boring into the raised section 36 so as to intersect both the fluid bore 90 and the cylinder 66 and thereafter filing the exterior portion of the piston connection bores with a piston connection plug 93 or the like.

The relief bore 98 includes a relief check valve 100 therein and is adapted to relieve the pressure within the fluid control system and to ensure that the pressure therein as well as within the bottom portion of the cylinders 66 does not reach a pressure which may cause damage to apparatus. In particular, as the extension pressure will be typically selected to be below the pressure required to fracture the formation, or the frac pressure, it will be necessary to ensure that such a higher frac pressure does not rupture the cylinder when it is applied to the interior of the bottom section 16. Frac pressures are known to often be 10,000 psi or higher and therefore the relief check valve 100 may be selected to have a opening pressure of between 5,000 and 8,000 psi.

With reference to FIG. 3, the entrance bore 94 intersect the central passage 32 of the valve body 24. As illustrated each entrance bore 94 may be covered by a knock-out plug 102 so as to seal the entrance bore until removed. In operation, as concrete is pumped down the bottom section 16, it will be followed by a plug so as to provide an end to the volume of concrete. The plug is pressurized by a pumping fluid (such as water, by way of non-limiting example) so as to force the concrete down the production string and thereafter to be extruded into the annulus between the horizontal section and the wellbore. The knock-out plugs 102 are designed so as to be removed or knocked-out of the entrance bore by the concrete plug passing thereby. In such a way, once the concrete has passed the valve body 24, the concrete plug removes the knock-out plugs 102 so as to pressurize the entrance bore 94 and fluid bore 90 and thereafter to extend the pistons 68 from the valve body 24 once the pressurizing fluid has reached a sufficient pressure.

Figure 7:
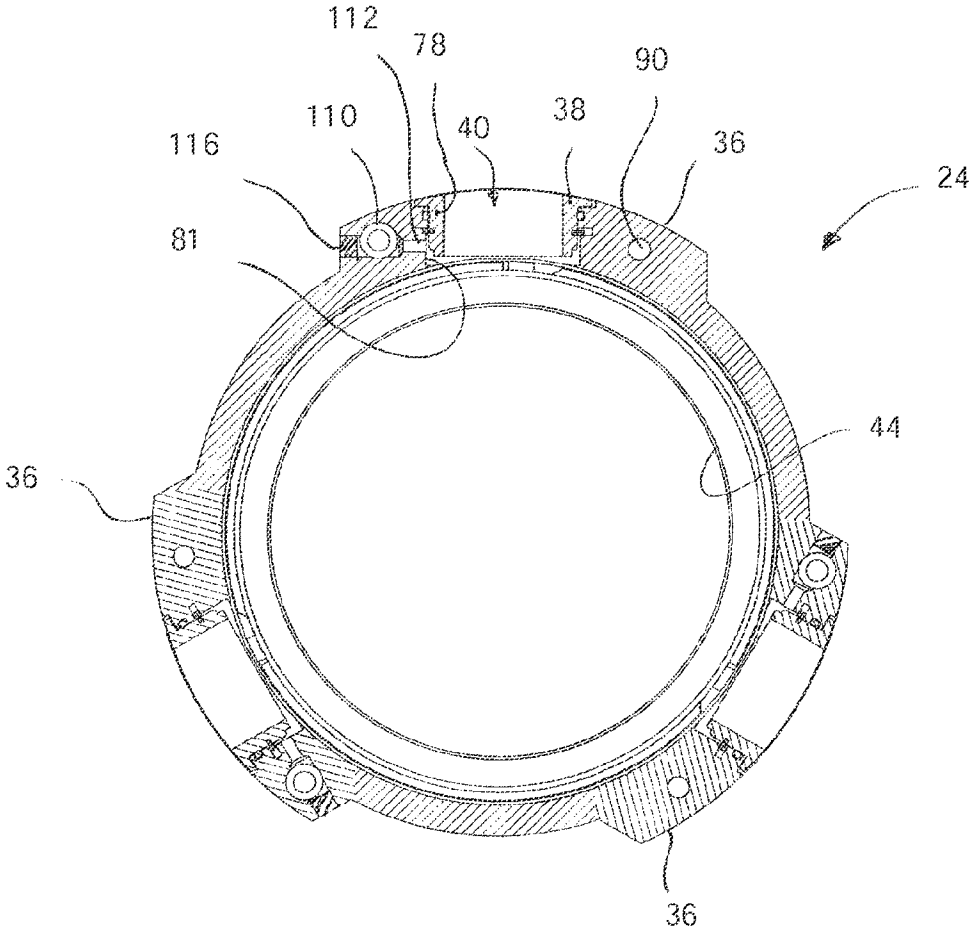

With reference to FIGS. 7 and 8, axial cross-sectional view of the valve body 24 is illustrated through the center of the aperture 40 and port body 38 and through the center of the pistons 68, respectively. Each raised section 36 includes a balancing bore 110 extending therealong substantially parallel to the central axis of the valve body 24. The balancing bore 110 extending between and entrance end 114 (shown on FIG. 2) and a connection bore 112 extending to the port bore 81. The balancing bore 110 may include a piston therein and be pre-filled with a fluid such as oil, by way of non-limiting example. In operation, the balancing bore 110 balances the pressure within the bore port 81 as the port body 38 is extended from the valve body 24. In particular, as the port body 38 is extended from the valve body, a negative pressure will be created within the space between the closed sliding sleeve 44 and the sealing body (not shown) located within the aperture 40 as this space is increased in volume. The balancing bore 110 reduces this negative pressure by providing an additional fluid contained therein to be drawn into the port bore 81 to fill this volume and balance the pressure therein with the pressures to the exterior of the valve body 24. As illustrated in FIG. 7, the connection bore 112 may be formed by boring into the raised section 36 so as to intersect both the balancing bore 110 and the port bore 81 and thereafter filing the exterior portion of the connection bore with a plug 116 or the like.

Figure 9:
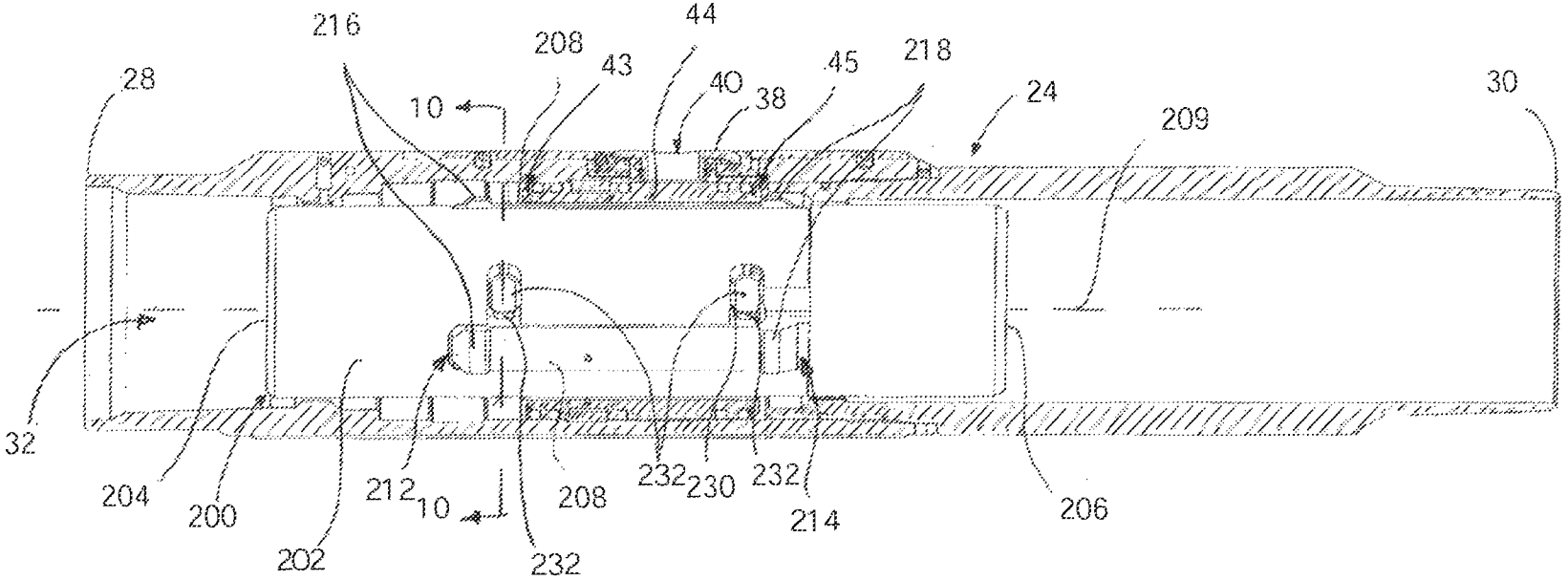
FIG. 9 is a cross sectional view of the valve of FIG. 2 as taken along the line 3-3 showing a shifting tool located therein.

Turning now to FIG. 9, a shifting tool 200 is illustrated within the central passage 32 of the valve body 24. The shifting tool 200 is adapted to engage the sliding sleeve 44 and shift it between a closed position as illustrated in FIG. 9 and an open position in which the apertures 40 are uncovered by the sliding sleeve 44 so as to permit fluid flow between and interior and an exterior of the valve body 24 as illustrated in FIG. 5. The shifting tool 200 comprises a substantially cylindrical elongate tubular body 202 extending between first and second ends 204 and 206, respectively. The shifting tool 200 includes a central bore 210 therethrough (shown in FIGS. 10 through 12) to receive an actuator or to permit the passage of fluids and other tools therethrough. The shifting tool 200 includes at least one sleeve engaging member 208 radially extendable from the tubular body 202 so as to be selectably engageable with the sliding sleeve 44 of the valve body 24. As illustrated in the accompanying figures, three sleeve engaging members 208 are illustrated although it will be appreciated that other quantities may be useful as well.

Figure 11:
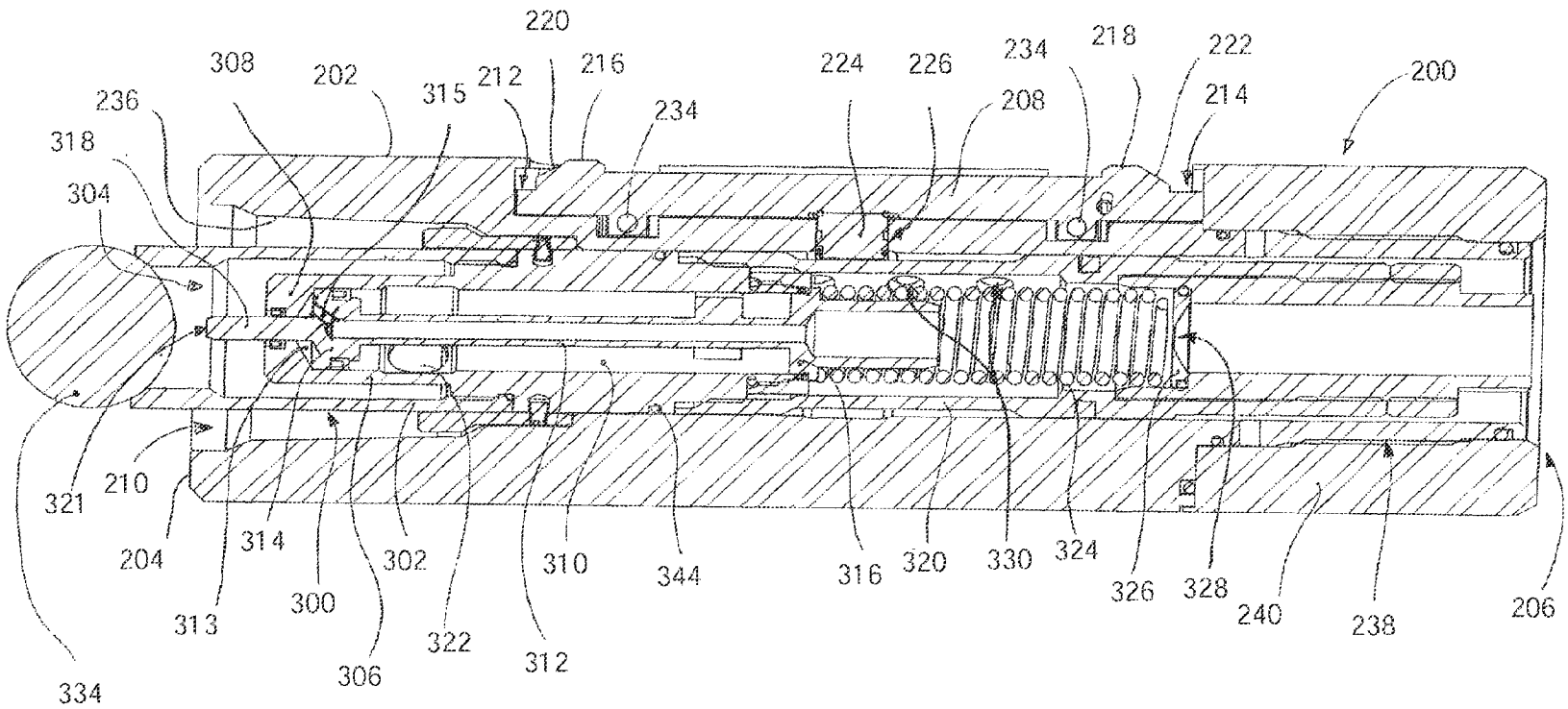
FIG. 11 a lengthwise cross sectional view of the shifting tool of FIG. 9 taken along the line 11-11 in FIG. 10 with a control valve located therein according to one embodiment with the sleeve engaging members located at a first or retracted position.
Figure 12:
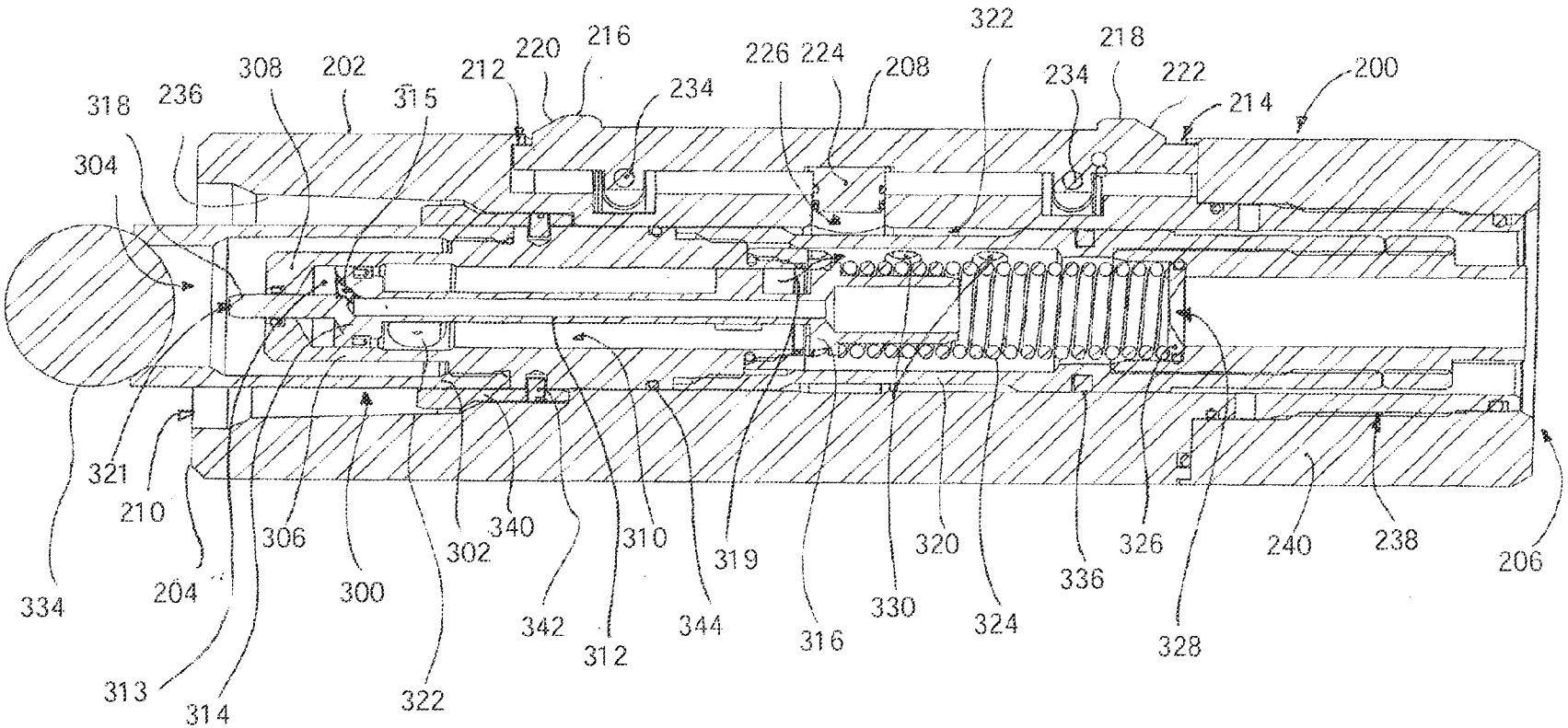
FIG. 12 is a cross sectional view of the shifting tool of FIG. 9 taken along the line 11-11 with a control valve located therein according to one embodiment with the sleeve engaging members located at a second or extended position
Figure 17:
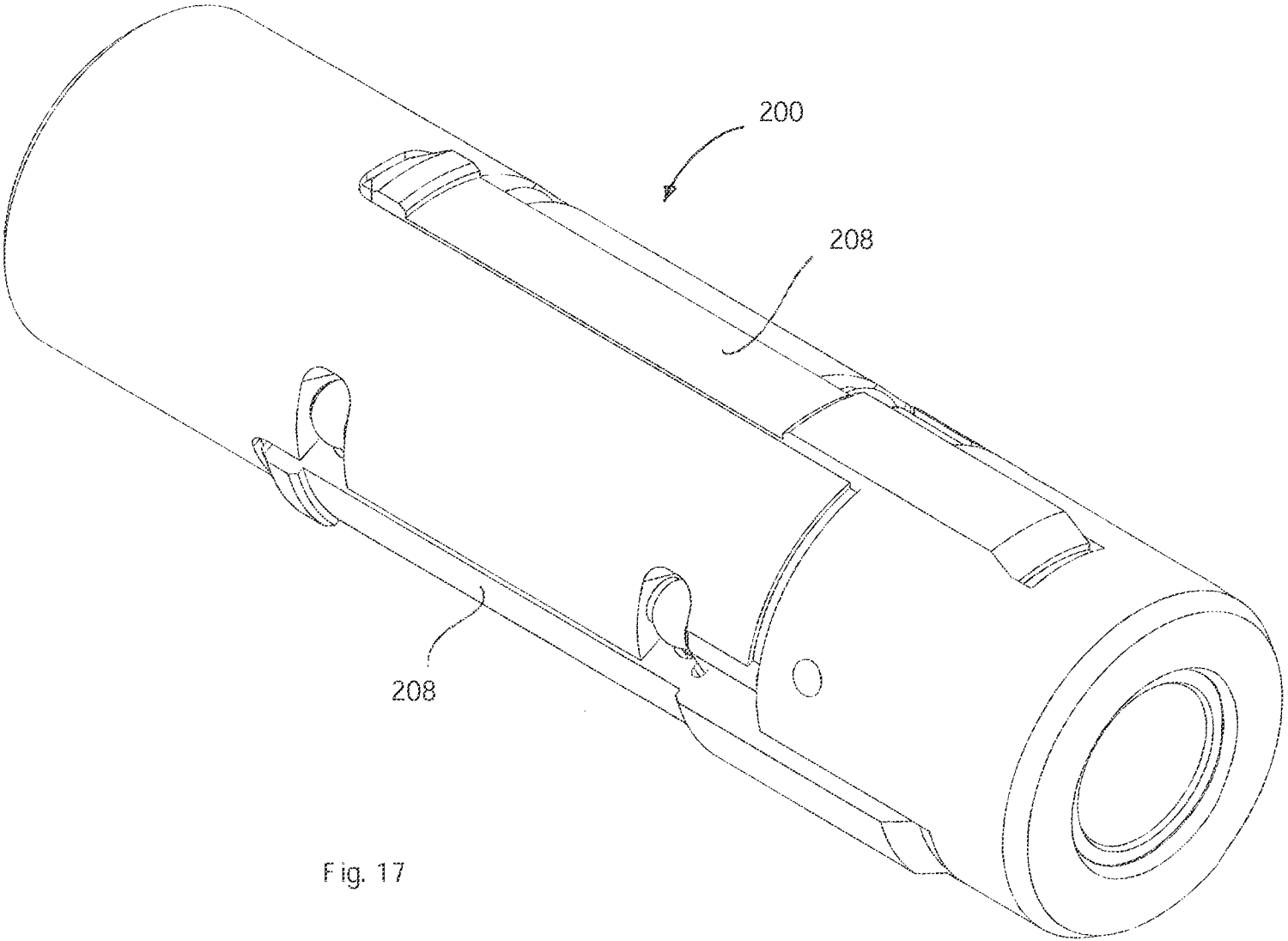
FIG. 17 is a perspective view of a shifting tool according to a further embodiment.

The sleeve engaging members 208 comprise elongate members extending substantially parallel to a central axis 209 of the shifting tool between first and second ends 212 and 214, respectively. The first and second ends 212 and 214 include first and second catches 216 and 218, respectively for surrounding the sliding sleeve and engaging a corresponding first or second end 43 or 45, respectively of the sliding sleeve 44 depending upon which direction the shifting tool 200 is displaced within the valve body 24. As illustrated in FIGS. 11 and 12, the first and second catches 216 and 218 of the sleeve engaging member 208 each include and inclined surface 220 and 222, respectively facing in opposed directions from each other. The inclined surfaces 220 and 222 are adapted to engage upon either the first or second annular shoulder 46 or 48 of the valve body as the shifting tool 200 is pulled or pushed there into. The first or second annular shoulders 46 or 48 press the first or second inclined surface 220 or 222 radially inwardly so as to press the sleeve engaging members 208 inwardly and thereby to disengage the sleeve engaging members 208 from the sliding sleeve 44 when the sliding sleeve 44 has been shifted to a desired position proximate to one of the annular shoulders. In an optional embodiment, one or both of the catches 216 or 218 may have an extended length as illustrated in FIG. 17 such that the sleeve engaging members are disengaged from the sliding sleeve at a position spaced apart from one of the first or second annular shoulders 46 or 48 and thereby adapted to position the sliding sleeve at a third or central position within the valve body 24.

Figure 10:
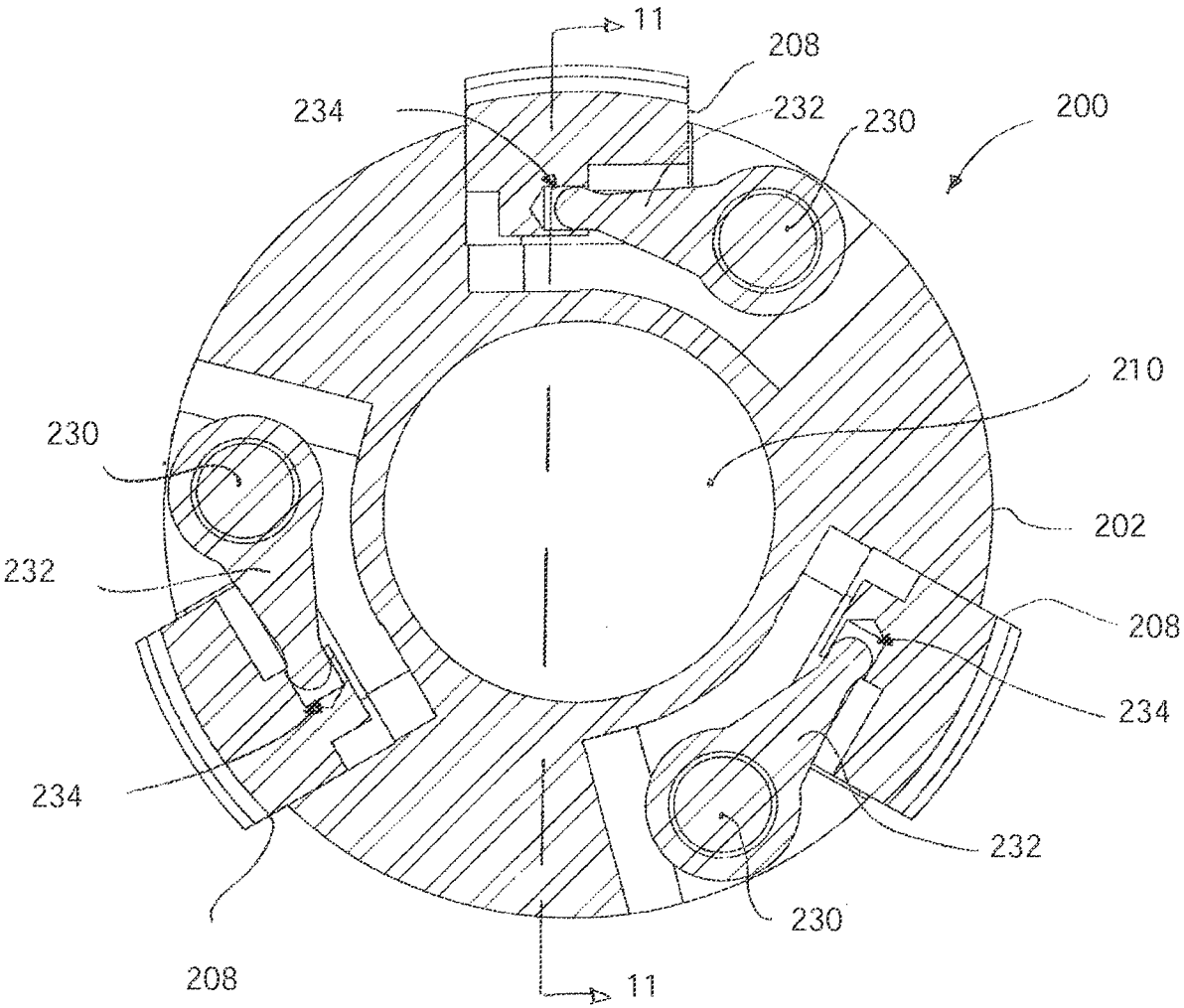
FIG. 10 is an axial cross-sectional view of the shifting tool of FIG. 9 as taken along the line 10-10.

Turning to FIG. 10, the sleeve engaging members are maintained parallel to the tubular body 202 of the shifting tool 200 by a parallel shaft 230. Each parallel shaft 230 is linked to a sleeve engaging member 208 by a pair of spaced apart linking arms 232. The parallel shaft 230 is rotatably supported within the shifting tool tubular body 202 by bearings or the like. The linking arms 232 are fixedly attached to the parallel shaft 230 at a proximate end and are received within a blind bore 234 of the sleeve engaging members 208. As illustrated in FIG. 9, the linking arms 232 are longitudinally spaced apart from each other along the parallel shaft 230 and the sleeve engaging member 208 so as to be proximate to the first and second ends 212 and 214 of the sleeve engaging member 208.

Turning now to FIG. 11, the tubular body 202 of the shifting tool includes a shifting bore 226 therein at a location corresponding to each sleeve engaging member. The shifting bore 226 extends from a cavity receiving the sleeve engaging member to the central bore 210 of the shifting tool 200. Each sleeve engaging member 208 includes a piston 224 extending radially therefrom which is received within the shifting bore 226. In operation, a fluid pressure applied to the central bore 210 of the shifting tool will be applied to the piston 224 so as to extend the piston within the shifting bore 226 and thereby to extend the sleeve engaging members 208 from a first or retracted position within the shifting tool tubular body 202 as illustrated in FIG. 11 to a second or extended position for engagement on the sliding sleeve 44 as discussed above as illustrated in FIG. 12. The parallel shafts also include helical springs (not shown) thereon to bias the sleeve engaging members to the retracted position.

The first end 204 of the shifting tool 200 includes an internal threading 236 therein for connection to the external threading of the end of a production string or pipe (not shown). The second end 206 of the shifting tool 200 includes external threading 238 for connection to internal threading of a downstream productions string or further tools, such as by way of non-limiting example a control valve as will be discussed below. An end cap 240 may be located over the external threading 238 when such a downstream connection is not utilized.

With reference to FIGS. 11 and 12, a first control valve 300 according to a first embodiment located within a shifting tool 200 for use in wells having low hydrocarbon production flow rates. The low flow control valve 300 comprises a valve housing 302 having a valve passage 304 therethrough and seals 344 therearound for sealing the valve housing 302 within the shifting tool 200. The low flow control valve 300 includes a central housing extension 306 extending axially within the valve passage 304 and a spring housing portion 320 downstream of the central portion 310. The central housing extension 306 includes an end cap 308 separating an entrance end of the valve passage from a central portion 310 of the valve passage and an inlet bore 322 permitting a fluid to enter the central portion 310 from the valve passage 304.

The central portion 310 of the valve passage contains a valve piston rod 312 slidably located therein. The valve piston rod 312 includes leading and trailing pistons, 314 and 316, respectively thereon in sealed sliding contact with the central portion 310 of the valve passage. The leading piston 314 forms a first chamber 313 with the end cap 308 having an inlet port 315 extending through the leading piston 314. The valve piston rod 312 also includes a leading extension 318 having an end surface 321 extending from an upstream end thereof and extending through the end cap 308. The valve piston rod 312 is slidable within the central portion 310 between a closed position as illustrated in FIG. 11 and an open position as illustrated in FIG. 12. In the closed position, the second or trailing piston 316 is sealable against the end of the central portion 310 to close or seal the end of the central passage and thereby prevent the flow of a fluid through the control valve. In the open position as illustrated in FIG. 12, the trailing piston 316 is disengagable from the end of the central portion 310 so as to provide a path of flow, generally indicated at 319, therethrough from the central passage to the spring housing.

A spring 324 is located within the spring housing 320 and extends from the valve piston rod 312 to an orifice plate 326 at a downstream end of the spring housing 320. The spring 324 biases the valve piston rod 312 towards the closed position as illustrated in FIG. 11. Shims or the like may be provided between the spring 324 and the orifice plate 326 so as to adjust the force exerted by the spring upon the valve piston rod 312. In other embodiments, the orifice plate may be axially moveable within the valve body by threading or the like to adjust the force exerted by the spring. In operation, fluid pumped down the production string to the valve passage 304 passes through the inlet bore and into the central portion 310. The pressure of the fluid within the central portion 310 is balanced upon the opposed faces of leading and trailing pistons 314 and 316 such that the net pressure exerted upon the valve piston rod 312 is provided by the pressure exerted on the end surface 321 of the leading extension 318 and on the leading piston 314 from within the first chamber 313. The resulting force exerted upon the end surface 321 is resisted by the biasing force provided by the spring 324 as described above.

Additionally, the orifice plate 326 includes an orifice 328 therethrough selected to provide a pressure differential thereacross under a desired fluid flow rate. In this way, when the fluid is flowing through the central portion 310 and the spring housing 320, the spring housing 320 will have a pressure developed therein due to the orifice plate. This pressure developed within the spring housing 320 will be transmitted through apertures 330 within the spring housing to a sealed region 332 around the spring housing proximate to the shifting bore 226 of the shifting tool 200. This pressure serves to extend the pistons 224 within the shifting bores 226 and thereby to extend the sleeve engaging members 208 from the shifting tool. The pressure developed within the spring housing 320 also resists the opening of the valve piston rod 312 such that in order for the valve to open and remain open, the pressure applied to the entrance of the valve passage 304 is required to overcome both the biasing force of the spring 324 and the pressure created within the spring housing 320 by the orifice 328.

The valve 300 may be closed by reducing the pressure of the supplied fluid to below the pressure required to overcome the spring 324 and the pressured created by the orifice 328 such that the spring is permitted to close the valve 300 by returning the valve piston rod 312 to the closed position as illustrate in 11 as well as permitting the springs on the parallel shaft 230 to retract the sleeve engaging members 208 as the pressure within the spring housing 320 is reduced. Seals 336 as further described below may also be utilized to seal the contact between the spring housing 320 and the interior of the central bore 210 of the shifting tool 200.

A shear sleeve 340 may be secured to the outer surface of the valve housing 302 by shear screws 342 or the like. The sheer sleeve 340 is sized and selected to be retained between a pipe threaded into the internal threading 236 of the shifting tool 200 and the remainder of the shifting tool body. In such a way, should the valve be required to be retrieved, a spherical object 334, such as a steel ball, such as are commonly known in the art may be dropped down the production string so as to obstruct the valve passage 304 of the valve 300. Obstructing the flow of a fluid through the valve passage 304 will cause a pressure to develop above the valve so as to shear the shear screws 342 and force the valve through the shifting tool. The strength of the sheer screws 342 may be selected so as to prevent their being sheered during normal operation of the valve 300 such as for pressures of between 1000 and 3000 psi inlet fluid pressure. The valve illustrated in FIGS. 11 and 12 is adapted for use in a low hydrocarbon flow rate well. In such well types, the flow of fluids such as hydrocarbons or other fluids is low enough that the fluid pumped down the well to pressurize the central portion 310 is sufficient to overcome the flow of the fluids up the well so as to pass through the orifice 328. It will be appreciated that for wells of higher well pressure or flow rates, such a valve will be limited in its application.

Figure 13:
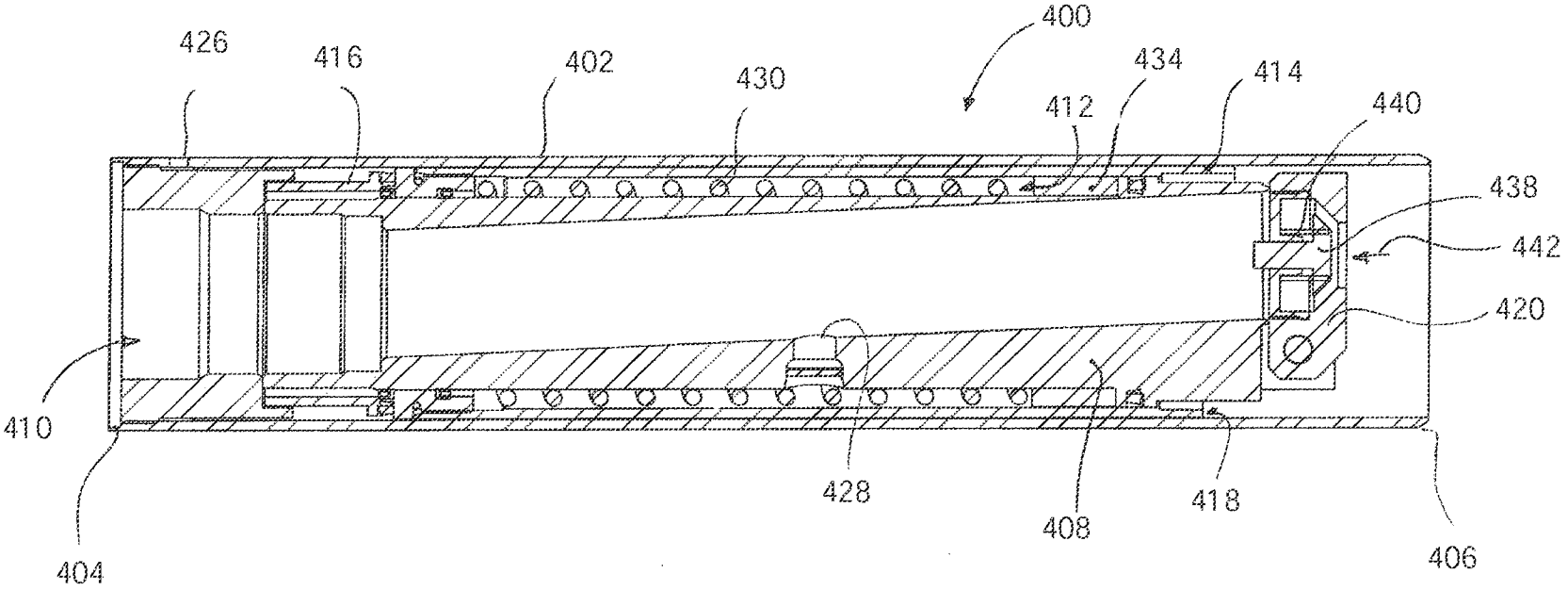
FIG. 13 is a cross sectional view of a control valve according to a further embodiment for actuating the sleeve engaging members at a closed position.
Figure 14:
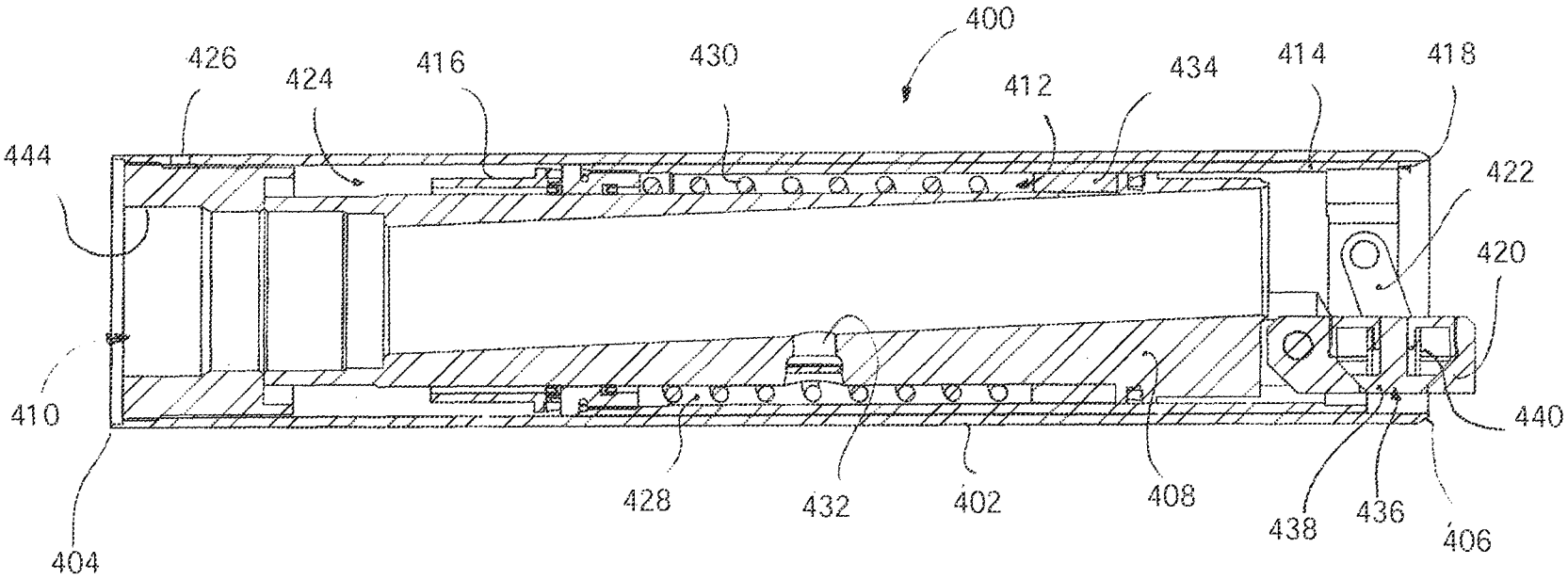
FIG. 14 is a cross sectional view of a control valve according to a further embodiment for actuating the sleeve engaging members at an open position.

Turning now to FIGS. 13 and 14, a second control valve 400 according to a further embodiment located for use in wells having high hydrocarbon production flow rates is illustrated. The high flow control valve 400 comprises an outer tubular body 402 extending between first and second ends 404 and 406, respectively. An inner tubular body 408 is located within the outer tubular body 402 having a central passage 410 therethrough and forming an annular cavity 412 with the outer tubular body. A flap 420 is pivotally connected to a distal end of the inner tubular body 408. The flap 420 selectably closes and seals the central passage 410 as the flap 420 is rotated into a first or closed position as illustrated in FIG. 13. The flap 420 may also be rotated to a second or open position as illustrated in FIG. 14 so as to permit fluids and tools to be passed through second control valve 400.

An elongate longitudinally displacable sleeve 414 is received within the annular cavity 412. The sleeve 414 includes an annular piston 416 at a first end and a free second end 418. The second end 418 is connected to the flap 420 by a linkage 422 such that when flap 420 is rotated to the open position as illustrated in FIG. 14, the sleeve will be extended towards the second end 406 of the control valve 400. Similarly, when the flap 420 is rotated to the closed position as illustrated in FIG. 13, the sleeve 414 is retracted towards the first end 404.

The annular piston 416 is located within a first end 424 of the annular cavity 412 proximate to the first end 404 of the valve 400. The first end 424 is in fluidic communication with an annulus around the exterior of the outer tubular body 402 and also the distal end of the control valve 400 through a bore hole 426. The annular sleeve 414 is approximately hydrostatically balanced due to the same pressurized fluid from the wellbore being present at the second end 418 of the sleeve as well as upon the annular piston 416 within the first end 424. Biasing the annular piston 416 towards the first end of the control valve 400 is a spring 430 contained within a spring cavity 428 between the annular sleeve 414 and the outer tubular body 402. Additionally a spring cavity 428 may include an internal bore 432 from the central passage 410 so as to port or introduce a fluid into the spring cavity 428 and thereby prevent any fluid contained therein from acting as a further biasing spring. The force exerted upon the annular piston 416 may be adjusted by providing one or more shims 434 at an opposite end of the spring from the annular piston 416.

In a free resting state, the spring 430 biases the piston towards the first end 404 of the control valve and thereby maintains the flap 420 in the closed position. The flap 420 may be opened by pumping a fluid down the production string so as to introduce a pressurized fluid into the central passage thereof. The pressurized fluid forces the flap 420 open as illustrated in FIG. 14 when the flow and pressure of the pressurized fluid is sufficient to overcome the force of the spring 430.

The flap 420 may optionally include a check valve 436 therein comprising a plug 438 compressed into the flap 420 by a spring 440 or the like. When a closed flap 420 experiences a pressure from the bottom of the well greater than the set point of the check valve, the well pressure will displace the plug 438 against the spring 440 in a direction generally indicated at 442 in FIG. 13. This will then open the check valve and permit fluid to flow past the check valve in direction 442. The central passage 410 of the valve also includes internal threading 444 adapted to be threadably secured to the external threading 238 of a shifting tool as described above. In such a connection, it will be appreciated that the end cap 240 of the sleeve engaging member must be removed to permit access to the external threading 238.

In operation, the control valve 400 actuates the sleeve engaging members of the shifting tool by providing a pressurized fluid to the common passage through the shifting tool 200 and the valve 400. When the central passage is pressurized to a sufficient pressure by a fluid pumped down the production string, the fluid from the central passage forces the flap 420 open. Thereafter, the fluid will need to be pumped down the production string at a sufficiently high volume so as to maintain the pressure within the production string at a pressure sufficient to act upon the pistons 224 so as to extend the sleeve engaging members 208.

Figure 15:
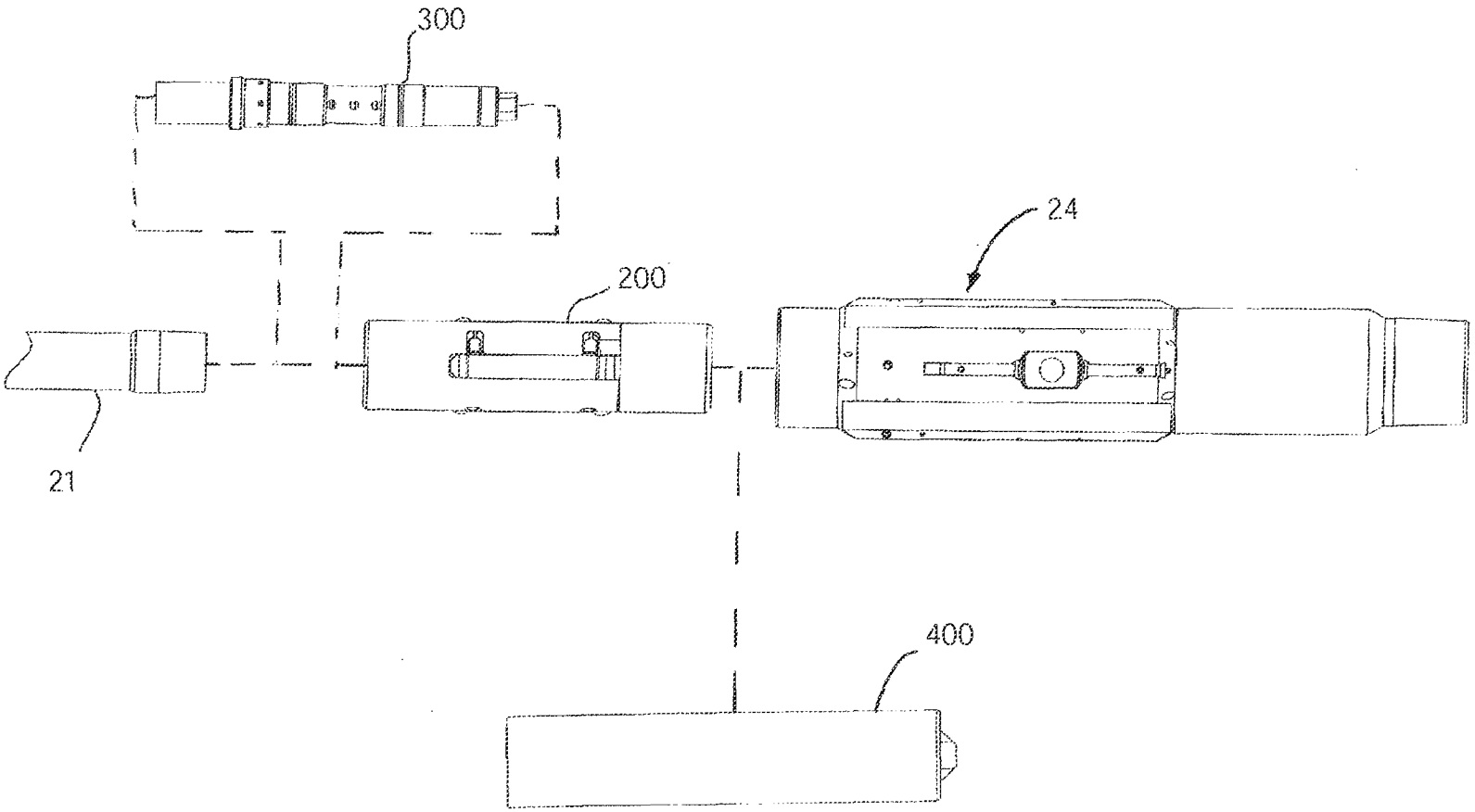
FIG. 15 is a schematic view of a system for controlling fluid flow through a wellbore.

Turning now to FIG. 15, a schematic view of a system according to the present invention is illustrated. The system may include one or more valve bodies 24 located within a bottom section 16 as described above. In operation, a user may extend a shifting tool 200 down the bottom section to shift the sliding sleeve 44 at the end of a production casing 21. The shifting tool 200 may be actuated by either the first valve 300 which is located within the shifting tool 200 or by the second valve 400 which is located to a distal end of the shifting tool.

Figure 16:
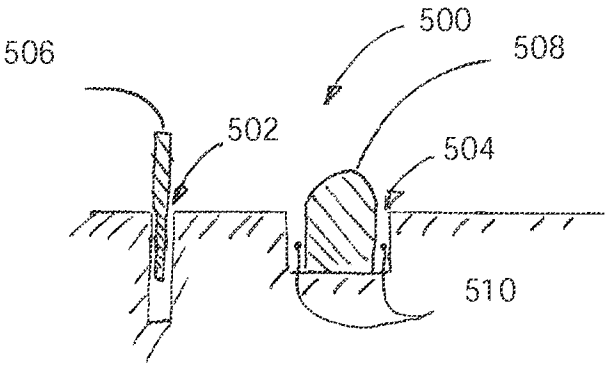
FIG. 16 is a cross sectional view of a seal for use between tool parts in a wellbore.

With reference to FIG. 16, one or more of the seals for use with the above system may comprise first and second spaced apart grooves 502 and 504, respectively. The first groove is sized to receive a wiper 506, such as a radially compressible ring having a gap therein as are commonly known in the art. As illustrated, the wiper 506 may have an uncompressed radius greater than the radius of the first groove 502 so as to provide a radial space into which the wiper may be compressed. The second groove is sized to receive a vulcanized rubber seal 508 therein such that a gap, generally indicated at 510 is left between the seal 508 and the sides of the second groove 504. The top of the seal 508 may be domed such that as the seal encounters an opposed surface (not shown) the seal is pressed down into the second groove to fill the gaps 510. The gaps 510 may have a distance of between 0.010 and 0.50 inches although it will be appreciated that other gap distances may be used as well. When the seal encounters a space in the opposed surfaces, such as for example at a port or the like the seal is permitted to expand to it's uncompressed shape to limit the volume of fluid which may be permitted to pass into the port.

While specific embodiments of the invention have been described and illustrated, such embodiments should be considered illustrative of the invention only and not as limiting the invention as construed in accordance with the accompanying claims.

What is claimed is:

1. A method for selectably opening a valve body in a well casing having a central passage and a plurality of apertures therethrough, the method comprising:

providing a sleeve slidably located within said central passage of said valve body adapted to selectably cover or uncover said apertures, said sleeve located in one of a first or second position;

positioning a shifting tool slidably locatable within said sleeve;

extending at least one sleeve engaging member from said shifting tool so as to remain parallel to a central axis of said shifting tool into engagement upon first and second ends of said sleeve;

axially moving said shifting tool and said sleeve to another of said first or second positions.

2. The method of claim 1 further comprising disengaging said at least one sleeve engaging member from said sleeve at said other of said first or second positions.

3. The method of claim 1 further comprising securing the shifting tool a production casing nested within said well casing.

4. The method of claim 1 further comprising supplying a central bore extending through the shifting tool with a pressurized fluid, wherein the central bore includes a plurality of shifting bores extending therefrom, each shifting bore having a piston therein operably connected to one of said sleeve engaging members for extending said sleeve engaging member when said central bore is supplied with the pressurized fluid.

5. The method of claim 1 further comprising engaging a first end and a second end of the sleeve with a first catch and a second catch of the sleeve engaging members.

6. The method of claim 5 further comprising engaging a raised portion of the central passage with a first inclined surface of the sleeve engaging member as the sleeve is moved into the first position and thereby disengaging the catches from the sleeve.

7. The method of claim 5 further comprising engaging a raised portion of the central passage with a second inclined surface of the sleeve engaging member as the sleeve is moved into the second position and thereby disengaging the catches from the sleeve.

8. The method of claim 1 further comprising maintaining the sleeve engaging member parallel to the central axis using a shaft extending therealong and at least two linking arms extending from the shaft to the sleeve engaging member.

9. The method of claim 8 wherein the linking arms are received within sockets within the sleeve engaging member.

* * * * *